US006350192B1

(12) United States Patent
Kibihara

(10) Patent No.: US 6,350,192 B1
(45) Date of Patent: Feb. 26, 2002

(54) COIN CARRYING DEVICE

(75) Inventor: Fumio Kibihara, Himeji (JP)

(73) Assignee: Glory Kogyo Kabushiki Kaisha, Hyogo-ken (JP)

( * ) Notice: Subject to any disclaimer, the term of this patent is extended or adjusted under 35 U.S.C. 154(b) by 0 days.

(21) Appl. No.: 09/560,282

(22) Filed: Apr. 27, 2000

(30) Foreign Application Priority Data

Apr. 28, 1999 (JP) ..... 11-122631

(51) Int. Cl.[7] ..... G07D 1/00
(52) U.S. Cl. ..... 453/50; 453/51
(58) Field of Search ..... 453/50, 51; 221/267

(56) References Cited

U.S. PATENT DOCUMENTS 824,842 A * 7/1906 Brandt ..... 453/52 X
1,113,920 A * 10/1914 Waugh ..... 453/52
1,615,642 A * 1/1927 Martine ..... 453/52
4,943,258 A * 7/1990 Abe ..... 453/50 X
5,810,655 A * 9/1998 Suzukawa et al. ..... 453/50
5,876,275 A * 3/1999 Rasmussen ..... 221/267 X

FOREIGN PATENT DOCUMENTS

DE 3522119 * 1/1986 ..... 453/50
GB 2211177 * 6/1989 ..... 453/50

* cited by examiner

*Primary Examiner*—James R. Bidwell
(74) *Attorney, Agent, or Firm*—Wenderoth, Lind & Ponack, L.L.P.

(57) ABSTRACT

A coin carrying device has a carrying structure defining a carrying passage (20) along which a plurality of coins are carried in a diametrical row. The coins fed by a rotary disk (4) onto the carrying passage (20) are carried along the carrying passage (20) by a carrying belt (8). A stopping member (43) stops the coins temporarily before the coins reach the exit of the carrying passage (20). The coin carrying device includes a coin separating lever (50). The coin separating lever (50) has a roller (51) capable of being laterally advanced into and retracted from the carrying passage (20) at a position downstream from the second coin from the head coin stopped in the carrying passage (20) by the stopping member (43). When advanced into the carrying passage (20), the roller (51) is shoved out of the carrying passage (20) against the resilience of a spring (52) by the coin that comes into contact with the roller (51). The roller (51) is returned to the position in the carrying passage (20) by the resilience of the spring (52) after the coin has passed the roller (51).

26 Claims, 6 Drawing Sheets

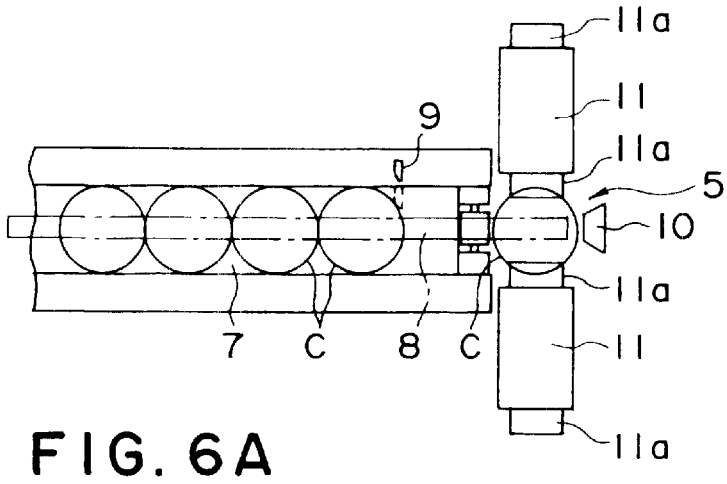
FIG. 6A
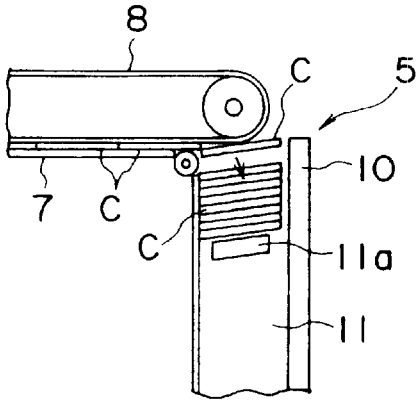
FIG. 6B
FIG. 7A
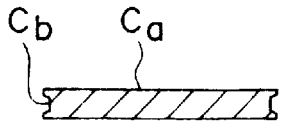
FIG. 7B
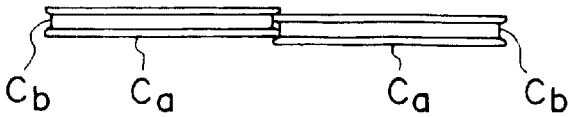

COIN CARRYING DEVICE

BACKGROUND OF THE INVENTION

1. Field of the Invention

The present invention relates to a coin carrying device to be incorporated into a coin handling machine, such as a coin wrapping machine or a coin sorting machine and, more particularly, to a coin carrying device suitable for carrying coins having a periphery provided with circumferential groove.

2. Description of the Related Art

FIG. 5 shows a coin wrapping machine, i.e., an example of a coin handling machine, to which the present invention is applied. As shown in FIG. 5, the coin wrapping machine has a frame 1 having a coin hopper 2 with an open upper end for receiving coins, and. A rotary disk 3 for receiving coins loaded through the coin hopper 2 is disposed in the frame 1. A coin carrying device 6' is disposed adjacent to the rotary disk 3.

The coin carrying device 6' has a carrying passage 7 extending between an entrance and an exit to guide a plurality of coins in a single diametrical row from the entrance to the exit, and a rotary disk 4 for feeding coins one by one to the entrance of the carrying passage 7. The rotary disk 3 feeds coins to the rotary disk 4. An accumulating unit 5 is disposed at the exit of the carrying passage 7 to accumulate coins delivered thereto in a vertical stack.

Referring to FIGS. 6A and 6B showing a coin carrying mechanism for carrying coins fed by the rotary disk 4 along the carrying passage 7, a carrying belt 8 is extended over a central part of the carrying passage 7. A coin counter, not shown, that counts coins passed by the coin counter and a stopper 9 capable of being advanced into and retracted from the carrying passage 7 are disposed in a downstream section of the carrying passage 7. Every time a predetermined number of coins pass the coin counter, i.e., every time a predetermined number of coins are accumulated in the accumulating unit 5, the stopper 9 is advanced into the carrying passage 7 to restrain coins in the carrying passage 7 forcibly from being carried.

Coins C being carried in a horizontal position in a diametrical row along the carrying passage 7 by the carrying belt 8 are counted by the coin counter and the coins C are discharged through the exit of the carrying passage 7. Then, the coin C collides against a stopping wall 10 of the coin accumulating unit 5 and drops into a space between a pair of vertical belts 11 of the coin accumulating unit 5 (FIG. 5). Then, the coins C dropped into the space between the pair of vertical belts 11 are accumulated in a vertical stack on projections 11*a* projecting from the opposite surfaces of the vertical belts 11.

In the coin wrapping machine shown in FIG. 5, a wrapping unit 12 is disposed below the coin accumulating unit 5. The wrapping unit 12 receives a stack of coins C from the coin accumulating unit 5 and wraps the coins C in wrapping paper 13. A coin package thus formed by wrapping coins C by the wrapping unit 12 is discharged through a discharge opening 14 formed in a lower part of the frame 1.

Ordinary coins separate from the succeeding coins and drop smoothly into the coin accumulating unit 5 as shown in FIG. 6B. However, coins having a circumferential groove $C_b$ in the periphery thereof, such as a Euro two cent coin $C_a$ shown in FIG. 7A in a sectional view (such a coin will be referred to as "circumferentially grooved coin") cannot be normally accumulated by the conventional coin carrying device because of the following phenomenon.

When circumferentially grooved coins $C_a$ are carried successively in a row, the movement of the coins $C_a$ is checked by the stopper 9 advanced into the carrying passage 7 upon the passage of the predetermined number of the coins. At this moment, parts of the peripheries of the adjacent circumferentially grooved coins $C_a$ are liable to be meshed into the circumferential grooves $C_b$ of the adjacent coins $C_a$ as shown in FIG. 7B and the circumferentially grooved coins $C_a$ are liable to be linked with each other. Even if the head coin of the row of circumferentially grooved coins $C_a$ thus linked with each other reaches the coin accumulating unit 5 and collides against the stopping wall 10, the head circumferentially grooved coin $C_a$ is unable to drop normally and hence the circumferentially grooved coins $C_a$ cannot be normally stacked up.

SUMMARY OF THE INVENTION

Accordingly, it is an object of the present invention to provide a coin carrying device capable of properly carrying circumferentially grooved coins, such as Euro two cent coins, not to mention ordinary coins.

With the foregoing object in view, the present invention provides a coin carrying device comprising: a carrying structure defining a carrying passage along which coins are carried in a diametrical row, having an entrance and an exit; a coin feed mechanism for feeding coins one by one to the entrance of the carrying passage; a carrying mechanism for carrying the coins fed to the carrying structure from the entrance to the exit along the carrying passage; a stopping member disposed near the exit of the carrying passage so as to be advanced into and retracted from the carrying passage and capable of forcibly stopping the advancement of the coins when advanced into the carrying passage; a coin separating member having a contact part capable of being laterally advanced into and retracted from the carrying passage at a position downstream from the second coin from the head coin stopped in the carrying passage by the stopping member; and a biasing member for biasing the contact part of the coin separating member toward the carrying passage; wherein the contact part of the coin separating member advanced into the carrying passage is pressed against a periphery of the coin being carried, the contact part is urged away from the carrying passage by the coin passing the contact part against biasing force of the biasing member, and the contact part is advanced again by the biasing member into the carrying passage after the coin has passed the contact part.

The successive coins can be forcibly separated from each other near the exit of the carrying passage by the biasing force of the biasing member exerted through the contact part of the coin separating member on the preceding one of the adjacent coins. Consequently, the coins linked with each other or arranged in contact with each other when the advancement of the row of coins is stopped forcibly by the stopping member can be separated from each other before reaching the exit of the carrying passage. Therefore, circumferentially grooved coins, not to mention ordinary coins, can be separated from each other and can be properly carried.

Preferably, the coin carrying device further comprises a retaining mechanism capable of retaining the coin separating member with the contact part thereof retracted from the carrying passage.

When carrying coins other than circumferentially grooved coins, the retaining mechanism retains the coin separating member with the contact part thereof retracted from the carrying passage to prevent the coin separating member from useless actions.

Preferably, the width of the carrying passage can be adjusted to a value corresponding to a diameter of coins to be carried along the carrying passage, and the coin carrying device further comprises an interlocking mechanism interlocking the carrying structure with the coin separating member and capable of automatically retaining the coin separating member with the contact part thereof retracted from the carrying passage when the width of the carrying passage is adjusted.

When the width of the carrying passage is adjusted to a value corresponding to the diameter of a circumferentially grooved coins, the coin separating member can be automatically retained in a retracted state by the interlocking mechanism. Therefore, any special operation and any independent driving means for operating the retaining mechanism are unnecessary, operability is improved, and the use of the interlocking mechanism is advantageous in cost.

The contact part of the coin separating member may be a roller. The roller serving as the contact part enables smooth operation of the coin separating member.

The coin separating member may be a lever having one end provided with the contact part.

The biasing member may be a spring connected to the other end of the lever serving as the coin separating member.

BRIEF DESCRIPTION OF THE DRAWINGS

FIG. 6A is a plan view of a part around a coin accumulating unit included in a conventional coin carrying device;

FIG. 6B is a side elevation of the part shown in FIG. 6A;

FIG. 7A is a sectional view of a circumferentially grooved coin; and

FIG. 7B is a side elevation of circumferentially grooved coins, which are similar to the circumferentially grooved coin shown in FIG. 7A, in a state where parts of the peripheries of the coins are meshed into the circumferential grooves of the coins.

DESCRIPTION OF THE PREFERRED EMBODIMENTS

A coin carrying device in a preferred embodiment according to the present invention will be described as applied to the coin wrapping machine shown in FIG. 5.

Figure 5:
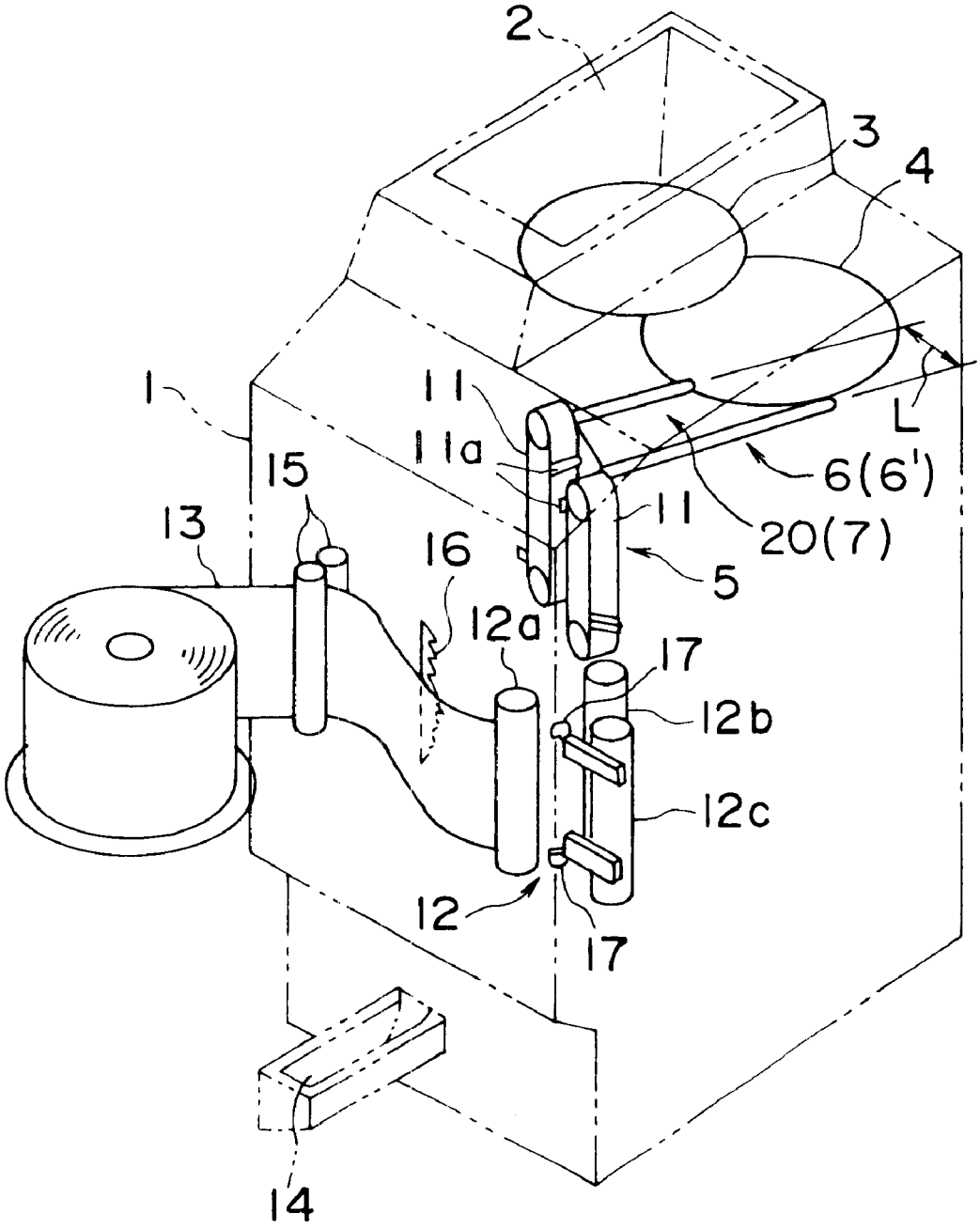
FIG. 5 is a schematic perspective view of a coin wrapping machine to which the present invention is applied.

Referring to FIG. 5, the coin wrapping machine has the frame 1 having the coin hopper 2 with the open upper end for receiving coins. The rotary disk 3 for receiving coins loaded through the coin hopper 2 is disposed in the frame 1. A coin carrying device 6 embodying the present invention is disposed adjacent to the rotary disk 3.

Figure 1:
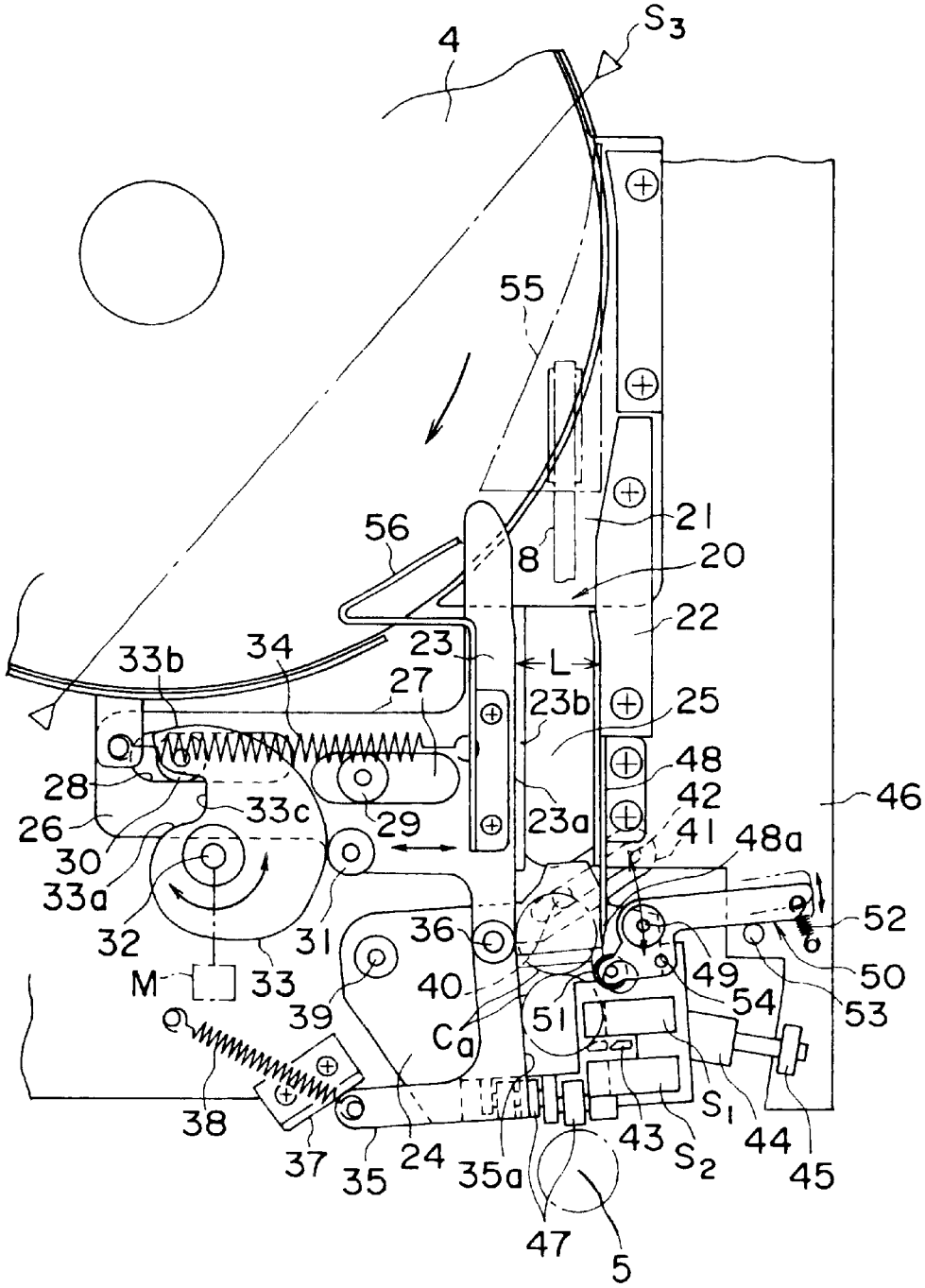
FIG. 1 is a plan view of a coin carrying device in a preferred embodiment according to the present invention in a state for carrying circumferentially grooved coins.

The coin carrying device 6 has a carrying passage 20 extending between an entrance to an exit to guide a plurality of coins in a single diametrical row from the entrance to the exit, and a rotary disk 4 for feeding coins one by one to the entrance of the carrying passage 20 (FIG. 1). The rotary disk 3 feeds coins to the rotary disk 4. The carrying passage 20 extends substantially tangentially to the rotary disk 4. The width L of the carrying passage 20 can be adjusted to a value corresponding to the diameter of coins to be carried along the carrying passage 20. An accumulating unit 5 is disposed at the exit of the carrying passage 20 to accumulate coins delivered thereto in a vertical stack.

Coins fed by the rotary disk 4 to the carrying passage 20 are carried by a carrying mechanism similar to that shown in FIGS. 6A and 6B along the carrying passage 20. The carrying mechanism includes a carrying a belt 8 extended above a central part of the carrying passage 20 as shown in FIG. 1. The carrying belt 8 is pressed against coins from above to carry the coins. In this specification, 'upstream side' signifies an upstream side with respect to a coin carrying direction or a side on the side of the entrance of the carrying passage 20, and 'downstream side' signifies a downstream side with respect to the coin carrying direction or a side on the side of the exit of the carrying passage 20.

Coins C are carried in a single diametrical row in a horizontal position along the carrying passage 20. A coin counter $S_1$ counts the coins C that passes by the same. The counted coins C are discharged through the exit. Then, the coins C, similarly to those shown in FIGS. 6A and 6B, collides against a stopping wall 10 of the coin accumulating unit 5 and drop into a space between a pair of vertical belts 11. Then, the coins C dropped into the space between the pair of vertical belts 11 are accumulated in a vertical stack on projections 11*a* projecting from the opposite surfaces of the vertical belts 11.

In the coin wrapping machine shown in FIG. 5, a wrapping unit 12 is disposed below the coin accumulating unit 5. The wrapping unit 12 receives stacked coins from the coin accumulating unit 5, and wraps the stacked coins in wrapping paper 13 by three wrapping rollers 12*a*, 12*b* and 12*c*. A coin package thus formed by the wrapping unit 12 is discharged through a discharge opening 14 formed in a lower part of the frame 1. In FIG. 5, indicated at 15 is a wrapping paper feed roller, at 16 is a wrapping paper cutter, and at 17 are crimping needles for crimping upper and lower end parts of the wrapping paper wrapped around the coin stack.

Figure 2:
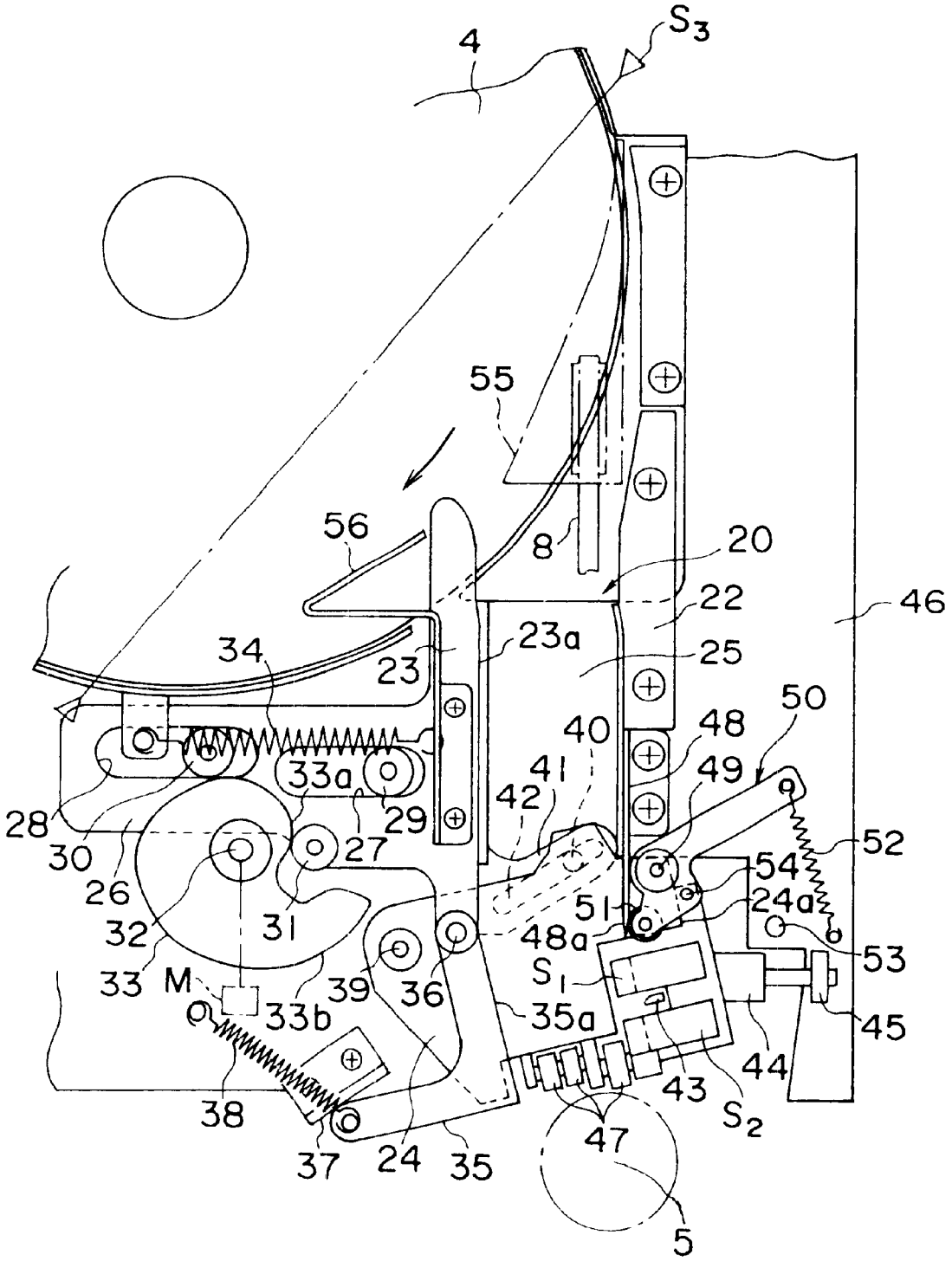
FIG. 2 is a plan view of the coin carrying device shown in FIG. 1 in a state where a carrying passage is set in a maximum width.
Figure 3:
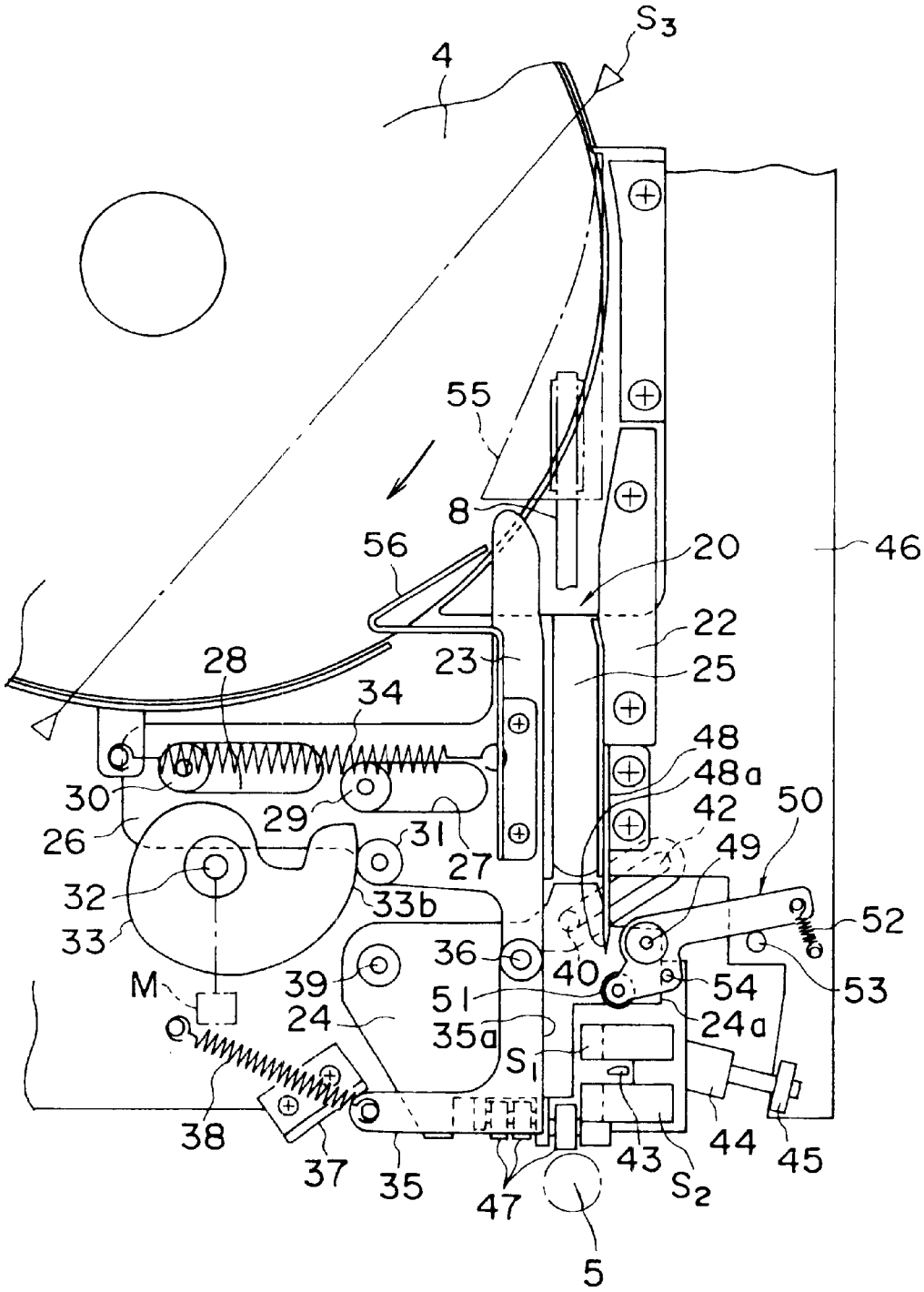
FIG. 3 is a plan view of the coin carrying device shown in FIG. 1 in a state where the carrying passage is set to a minimum width.

The coin carrying device 6 embodying the present invention will be described with reference to FIGS. 1 to 3. FIGS. 1 to 3 show the coin carrying device 6 set in different conformations differing from each other in the width L (FIG. 1) of the carrying passage 20, respectively. In FIGS. 1, 2 and 3, the carrying passage 20 of the coin carrying device 6 is set in a width for carrying the circumferentially grooved coin $C_a$ shown in FIG. 7A, in a maximum width and in a minimum width, respectively The carrying passage 20 is defined by a fixed guide member 22 and a movable guide member 23 disposed opposite to the fixed guide member 22. An entrance bottom plate 21 is disposed in a plane substantially the same as that including the rotary disk 4 at a position on the side of the entrance of the carrying passage 20. An exit bottom plate 24 is disposed at a position on the side of the exit of the carrying passage 20. A small-diameter coin eliminating opening 25 is defined by the fixed guide member 22, the movable guide member 23, the entrance bottom plate 21 and the exit bottom plate 24.

The movable guide member 23 has a straight guide part 23*a* provided with a step 23*b* for supporting coins thereon, and a leg part 26 horizontally extending from the back of the straight guide part 23*a*. The leg part 26 is provided with slots 27 and 28 extending in a direction perpendicular to the straight guide part 23*a*. Guide rollers 29 and 30 supported on the frame 1 are fitted in the slots 27 and 28, respectively, to support the movable guide member 23 for linear movement toward and away from the fixed guide member 22. A cam follower 31, i.e., a roller, is supported on the leg part 26. The movable guide member 23 is biased away from the fixed guide member 22 by a spring 34 so that the cam follower 31 is always in engagement with the cam surface of a stepless cam 33 supported for turning by a shaft 32 on the frame 1.

The stepless cam 33 has a spiral cam surface between a minimum stroke point 33*a* and a maximum stroke point 33*b*. Effective radius of the stepless cam 33 increases gradually from the minimum stroke point 33*a* toward the maximum stroke point 33*b*. A recess is formed in the periphery of the stepless cam 33 in a section near the minimum stroke point 33*a*. The movable guide member 23 is disposed to form the carrying passage 20 in the maximum width when the cam follower 31 is in contact with the minimum stroke point 33*a* of the stepless cam 33 as shown in FIG. 2. The position of the stepless cam 33 in this state is an original position. The stepless cam 33 can be turned through a predetermined angle by a pulse motor M.

A substantially L-shaped auxiliary guide member 35 has one end pivotally joined by a joining pin 36 to a downstream end part of the movable guide member 23. The auxiliary guide member 35 is biased by a spring 38 so that the other end thereof is in contact with a guide member 37 fixed to the frame 1. The angle of a guide surface 35*a* of the auxiliary guide member 35 changes when the position of the movable guide member 23 is changed. The guide surface 35*a* of the auxiliary guide member 35 is turned relative to the straight guide part 23*a* of the movable guide member 23 toward the fixed guide member 22 as shown in FIG. 2 when the width of the carrying passage 20 is increased. The guide surface 35*a* of the auxiliary guide member 35 is turned relative to the straight guide part 23*a* of the movable guide member 23 away from the fixed guide member 22 toward a position where the guide surface 35*a* is aligned with the straight guide part 23*a* of the movable guide member 23 when the width of the carrying passage 20 is reduced. Consequently, an exit section of the carrying passage 20 is directed toward the center of the coin accumulating unit 5 regardless of the width of the carrying passage 20, and the free end of the guide surface 35*a* of the auxiliary guide member 35 approaches the coin accumulating unit 5 as the width of the carrying passage 20 is reduced to a width suitable for carrying small-diameter coins.

The exit bottom plate 24 has an end part on the side of the movable guide member 23 pivotally supported by a shaft 39 on the frame 1. A pin 40 projecting from the exit bottom plate 24 is fitted in a slot 42 formed in a projection 41 of the movable guide member 23 projecting toward the carrying passage 20. Thus, when the movable guide member 23 is moved toward the fixed guide member 22 to reduce the width of the carrying passage 20, i.e., when the movable guide member 23 is moved from a position shown in FIG. 2 toward a position shown in FIG. 3, the exit bottom plate 24 is turned gradually clockwise on the shaft 39.

The coin counter $S_1$ and a coin sensor $S_2$ capable of sensing a coin that passed by the coin sensor $S_2$ are supported side by side on a free end part of the exit bottom plate 24. The exit bottom plate 24 is turned so that the respective axes of the coin counter $S_1$ and the coin sensor $S_2$ are always substantially perpendicular to the guide surface 35*a* of the auxiliary guide member 35.

A stopping member 43 capable of being advanced into and retracted from the carrying passage 20 by a solenoid, not shown, is disposed between the coin counter $S_1$ and a coin sensor $S_2$. Upon the count of a predetermined number of coins by the coin counter $S_1$, i.e., every time a predetermined number of coins are accumulated in the coin accumulating unit 5, the stopping member 43 is advanced into the carrying passage 20 to stop the following coins forcibly on the carrying passage 20.

An arm 44 supporting a bottom plate support roller 45 is projected from the free end part of the exit bottom plate 24. The roller 45 rolls on a flat plate 46 attached to the frame 1 to support the free end part of the exit bottom plate 24. Guide rollers 47 are supported on a downstream end part of the exit bottom plate 24 to support a coin thereon.

A vertical side guide plate 48 is formed integrally with a downstream part of the fixed guide member 22 so as to extend over the upper surface of the exit bottom plate 24. A gap smaller than the thickness of coins having the smallest thickness among the coins to be handled is formed between the side guide plate 48 and the upper surface of the exit bottom plate 24.

A coin separating lever 50 is supported pivotally for a swing motion by a shaft 49 on a free end part of the exit bottom plate 24 at a position near a downstream end part 48*a* of the side guide plate 48. A small-diameter roller (contact part)51 is supported pivotally on a first end of the coin separating lever 50 on the side of the carrying passage 20. When a plurality of coins are stopped in the carrying passage 20 by the stopping member 43 as shown in FIG. 1, the roller 51 can be laterally advanced into and retracted from the carrying passage 20 to and from a space between the head coin and the second coin from the head. The roller 51 need not be necessarily advanced in the space between the head coin and the second coin from the head when the coin separating lever 50 is turned clockwise as viewed in FIG. 1 to advance the roller 51; the roller 51 may be moved into a space on the downstream side of the second coin. For example, the roller 51 may be moved into a space on the downstream side of the stopping member 43.

An extension spring 52 is extended between a second end part of the coin separating lever 50 and the flat plate 46 to bias the coin separating lever 50 clockwise. The clockwise turning of the coin separating lever 50 is limited by a stopper 53 attached to the flat plate 46.

A hole 54 is formed in the coin separating lever 50 at a position near the shaft 49. A lower part of a pin inserted in the hole 54 comes into contact with a stepped part 24*a* (FIG. 3) formed in a free end of the exit bottom plate 24 to restrain the coin separating lever 50 from clockwise turning. Thus, the pin and the exit bottom plate 24 constitute a retaining mechanism for retaining the coin separating lever 50 at an inoperative position with the roller 51 retracted from the carrying passage 20. The coin separating lever 50 may be retained at the inoperative position by other retaining means, such as a retaining means including a locking member for retaining the coin separating lever 50 at the inoperative position and a solenoid for operating the locking member.

The coin carrying device is provided with an interlocking mechanism capable of retaining the coin separating lever 50 with the roller 51 retracted from the carrying passage 20 when the movable guide member 23 is moved for passage width adjustment. In this embodiment, the interlocking mechanism includes the stepless cam 33 for passage width adjustment, the movable guide member 23, the exit bottom plate 24, the side guide plate 48 of the fixed guide member 22 and the stopper 53. Due to the interlocking mechanism, the roller 51 is advanced into the carrying passage 20 only when carrying the circumferentially grooved coins $C_a$, and is retracted from the carrying passage 20 when carrying coins other than the circumferentially grooved coins $C_a$. For further details refer to the description of operation.

In FIGS. 1 to 3, indicated at $S_3$ is a level sensor for detecting level and the presence of coins on the rotary disk 4, at 55 is a thickness limiting member to prevent feeding two superposed coins at a time to the carrying passage 20, and at 56 is a guide plate for guiding coins moving on the rotary disk 4 backward with respect to the rotating direction of the rotary disk 4 to prevent coins from piling up on the rotary disk 4. A gap greater than the thickness of each of the coins to be carried and smaller than twice the thickness of the coin is formed between the thickness limiting member 55 and the upper surface of the rotary disk 4. The guide plate 56 is attached to the movable guide member 23 so as to overlie the rotary disk 4.

Actions and functions of the coin carrying device thus constructed will be described hereafter.

The width of the carrying passage 20 is adjusted by moving the movable guide member 23 from the original position corresponding to the maximum width shown in FIG. 2 toward the fixed guide member 22 by turning the stepless cam 33 through a predetermined angle by the pulse motor M.

In a state shown in FIG. 2 where the carrying passage has the maximum width, the movable guide member 23 is at the leftmost position. Since the joining pin 36 joining the auxiliary guide member 35 to the downstream end part of the movable guide member 23 is at the leftmost position in this state, the guide surface 35*a* of the auxiliary guide member 35 is turned on the joining pin 36 toward the coin accumulating unit 5 at a maximum inclination. As the movable guide member 23 is moved to the left, the pin 40 is forced to move along the slot 42, so that the exit bottom plate 24 is turned counterclockwise on the shaft 39, the respective axes of the coin counter $S_1$ and the coin sensor $S_2$ remain substantially perpendicular to the guide surface 35*a* of the auxiliary guide member 35, and the center line of the section of the carrying passage 20 corresponding to the coin counter $S_1$ and the coin sensor $S_2$ passes the center of the coin accumulating unit 5.

The coin separating lever 50 is shifted upward as viewed in FIG. 2 when the exit bottom plate 24 is turned counterclockwise. The roller 51 supported on the coin separating lever 50 is pushed by the back surface of the downstream end part 48*a* of the side guide plate 48 opposite the surface of the same facing the carrying passage 20, so that the coin separating lever 50 is turned counterclockwise on the shaft 49 against the resilience of the spring 52. Therefore, when the movable guide member 23 is at the leftmost position corresponding to the maximum width of the carrying passage 20, the roller 51 is in contact with the back surface of the downstream end part 48*a* of the side guide plate 48 and kept retracted from the carrying passage 20.

When coins to be handled by the coin carrying device are specified, a predetermined number of driving pulses are given to the pulse motor M to turn the stepless cam 33 clockwise, as viewed in FIG. 2, to move the movable guide member 23 from the original position shown in FIG. 2 toward the fixed guide member 22 so that the width of the carrying passage 20 is adjusted to a value corresponding to the diameter of the coins.

When the movable guide member 23 is moved toward the rightmost position shown in FIG. 3 to reduce the width of the carrying passage 20 to the minimum width, the joining pin 36 is also moved to the right, the inclination of the guide surface 35*a* to the straight guide part 23*a* of the movable guide member 23 decreases and, eventually, the guide surface 35*a* is aligned with the straight guide part 23*a*.

The pin 40 engaged with the slot 42 is pushed down as the movable guide member 23 is moved toward the fixed guide member 22. Consequently, the exit bottom plate 24 is turned clockwise on the shaft 39, and the coin counter $S_1$ and the coin sensor $S_2$ are located on the extension of the side guide plate 48. In this state, the respective axes of the coin counter $S_1$ and the coin sensor $S_2$ are substantially perpendicular to the guide surface 35*a* of the auxiliary guide member 35, and the center of the coin accumulating unit 5 is substantially on the center line of the carrying passage 20.

The second end part of the coin separating lever 50 comes into contact with the stopper 53 and the roller 51 is held at the retracted position outside the carrying passage 20, i.e., on the outer side of the extension of the side guide plate 48. Therefore, the coins can be carried along the carrying passage 20 without being obstructed by the roller 51.

When handling the circumferentially grooved coins $C_a$ shown in FIG. 7A, a predetermined number of driving pulses are given to the pulse motor M to turn the stepless cam 33 through a predetermined angle to set the carrying passage 20 in a width corresponding to the diameter of the circumferentially grooved coins $C_a$ as shown in FIG. 1.

In this state, the roller 51 of the coin separating lever 50 is advanced slightly beyond the guide surface of the side guide plate 48 into the carrying passage 20 so that the circumferentially grooved coins $C_a$ being carried along the carrying passage 20 can be engaged with the roller 51. The effect of the coin separating lever 50 thus located on satisfactorily accumulating the circumferentially grooved coins $C_a$ in the coin accumulating unit 5 will be described with reference to FIG. 4.

Figure 4:
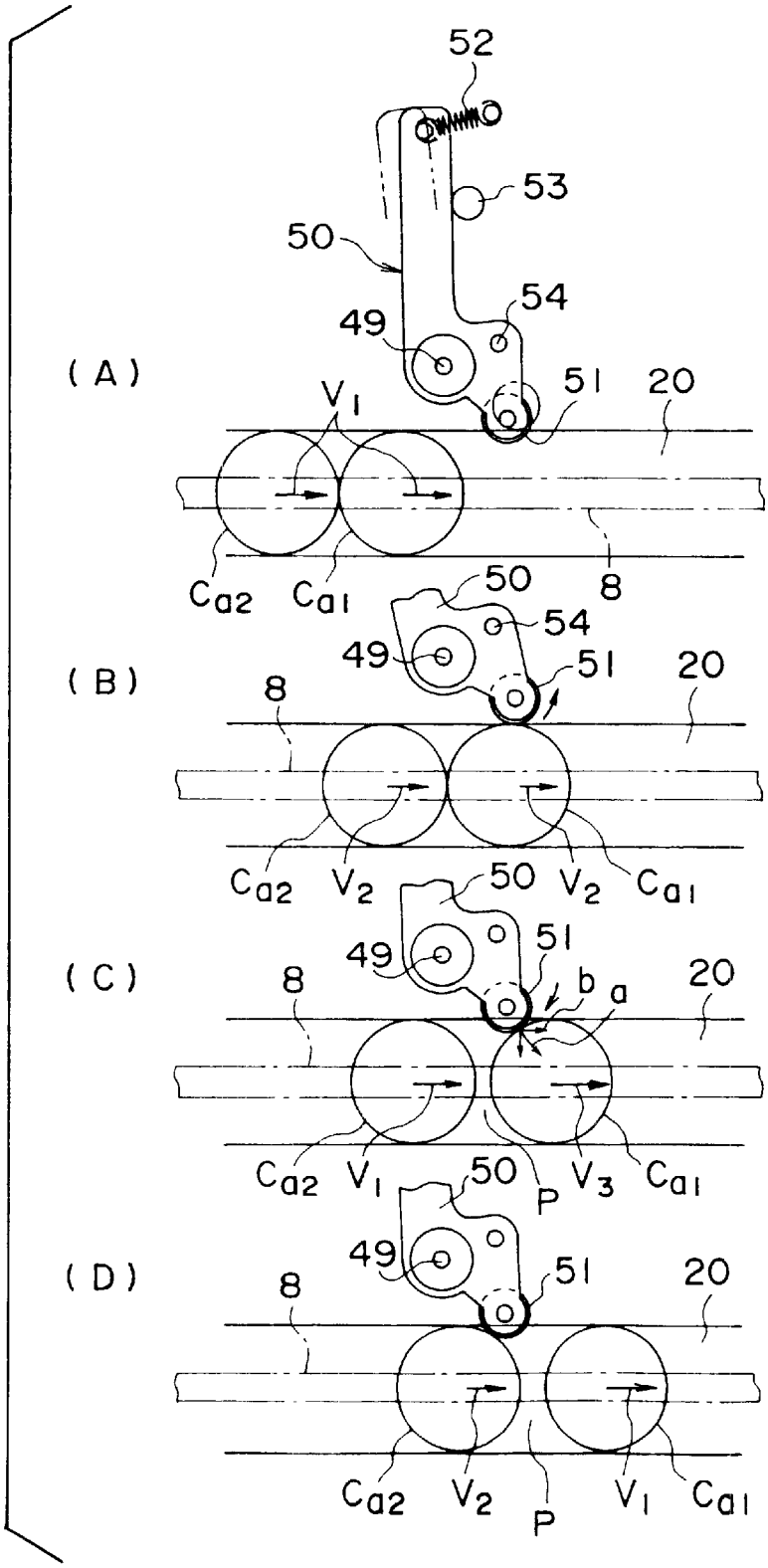
FIG. 4 is a diagrammatic view of assistance in explaining sequential operations of the coin carrying device shown in FIG. 1.

FIG. 4 shows two circumferentially grooved coins $C_{a1}$ and $C_{a2}$ being carried along the carrying passage 20 by the carrying belt 8 at different positions during different phases (A)–(D) of a coin carrying operation.

As shown in FIG. 4-(A), the periphery of the head coin $C_{a1}$ of the two coins $C_{a1}$ and $C_{a2}$ being contiguously carried at a speed $V_1$ comes into contact with the roller 51 of the coin separating lever 50. Then, as shown in FIG. 4-(B), the head coin $C_{a1}$ pushes the roller 51 to turn the coin separating lever 50 counterclockwise, as viewed in FIG. 4-(B), against the resilience of the spring 52 and the roller 51 is retracted outside the carrying passage 20 to a position indicated by broken line. At the same time, the advancement of the coins $C_{a1}$ and $C_{a2}$ is retarded by the resistance of the roller 51 against the action of the coins $C_{a1}$ and $C_{a2}$ to shove the roller 51 outside the carrying passage 20 and the speed of the coins $C_{a1}$ and $C_{a2}$ is reduced to a speed $V_2$.

As shown in FIG. 4-(C), as the preceding coin $C_{a1}$ passes by the roller 51 shoving the latter aside, the spring 52 exerts a force urging the preceding coin $C_{a1}$ in the carrying direction through the roller 51 on the preceding coin $C_{a1}$. After the highest point on the periphery of the preceding coin $C_{a1}$ has passed the roller 51, a vector a of a force exerted by the roller 51 on the preceding coin $C_{a1}$ has a component b of a force that urges the preceding coin $C_{a1}$ in the carrying direction. Thus, the force represented by the vector b is exerted on the preceding coin $C_{a1}$ in addition to a carrying force exerted on the same by the carrying belt 8. Consequently, the speed of the preceding coin $C_{a1}$ increases to a speed $V_3$, the preceding coin $C_{a1}$ advances relative to the succeeding coin $C_{a2}$ and the coins $C_{a1}$ and $C_{a2}$ are spaced an interval P apart from each other.

Subsequently, the succeeding coin $C_{a2}$ comes into contact with the roller 51 as sown in FIG. 4-(D). Then, the speed of the succeeding coin $C_{a2}$ is reduced from $V_1$ to $V_2$ and the interval P between the coins $C_{a1}$ and $C_{a2}$ is increased.

Since the preceding coin $C_{a1}$ is spaced from the succeeding coin $C_{a2}$ before the preceding coin $C_{a1}$ reaches the exit of the carrying passage 20, parts of the peripheries of the adjacent coins $C_{a1}$ and $C_{a2}$ are not meshed into the circumferential grooves of the coins $C_{a1}$ and $C_{a2}$, and the coins $C_{a1}$ and $C_{a2}$ are not linked with each other as shown in FIG. 7B. Thus, the preceding coin $C_{a1}$ can smoothly drop into the coin accumulating unit 5. Thus, all the circumferentially grooved coins $C_a$ can be successively separated from the succeeding coins and the circumferentially grooved coins $C_a$ can be smoothly accumulated in the coin accumulating unit 5.

When handling coins other than the circumferentially grooved coins $C_a$, the pin is inserted in the hole 54 of the coin separating lever 50. The pin rests on the stepped part 24*a* of the exit bottom plate 24 and thereby the roller 51 of the coin separating lever 50 can be retained at the inoperative position regardless of the adjustment of the width of the carrying passage 20.

It is desirable in view of efficiency to eliminate work for setting the coin separating lever 50 at the operative position when handling circumferentially grooved coins and for retaining the same at the inoperative position when handling coins other than circumferentially grooved coins by designing the coin carrying device so that the coin separating lever 50 is set automatically at the operative position or is retained automatically at the inoperative position by the operation for adjusting the width of the carrying passage. However, the coin separating lever 50 may be set manually at the operative position only when necessary or may be manually retracted to the inoperative position.

Incidentally, the present invention is not limited in its application to the carriage of the coins, but can be applied to the carriage of medals or the like.

What is claimed is:

1. A coin carrying device comprising:

a carrying structure defining a carrying passage along which coins are to be carried from an entrance of said carrying passage to an exit of said carrying passage;

a carrying mechanism to carry the coins along said carrying passage from the entrance of said carrying passage to the exit of said carrying passage;

a coin separating member having a contact part to be laterally advanced into and retracted from said carrying passage; and a biasing member to bias said contact part of said coin separating member toward said carrying passage, such that as coins are being carried by said carrying mechanism along said carrying passage from the entrance of said carrying passage to the exit of said carrying passage and said biasing member is biasing said contact part of said coin separating member into said carrying passage, a peripheral portion of one of the coins contacts said contact part of said coin separating member and causes said contact part of said coin separating member to be urged against said biasing member away from said carrying passage, and as the one of the coins passes said contact part of said coin separating member said biasing member biases said contact part of said coin separating member into said carrying passage, whereby at least one of the following occurs (i) said contact part of said coin separating member comes into contact with another peripheral portion of the one of the coins such that the one of the coins is accelerated relative to the coin immediately behind the one of the coins, whereby within said carrying passage near the exit of said carrying passage the one of the coins becomes spatially separated from the coin immediately behind the one of the coins, and (ii) said contact part of said coin separating member comes into contact with a peripheral portion of the coin immediately behind the one of the coins such that the coin immediately behind the one of the coins becomes decelerated relative to the one of the coins, whereby within said carrying passage near the exit of said carrying passage the one of the coins becomes spatially separated from the coin immediately behind the one of the coins.

2. The coin carrying device according to claim 1, wherein said carrying mechanism comprises a belt to be pressed against the coins such that said carrying mechanism is to carry the coins by moving said belt from the entrance of said carrying passage to the exit of said carrying passage.

3. The coin carrying device according to claim 2, further comprising a coin feed mechanism to feed coins one by one to the entrance of said carrying passage.

4. The coin carrying device according to claim 3, further comprising a stopping member near the exit of said carrying passage to be advanced into and retracted from said carrying passage to stop advancement of the coins through said carrying passage when said stopping member is in said carrying passage.

5. The coin carrying device according to claim 4, wherein said contact part of said coin separating member is positioned relative to said carrying passage and said stopping member such that when a coin in said carrying passage is in contact with said stopping member said biasing member biases said contact part of said coin separating member into said carrying passage at a location that is downstream from a coin in said carrying passage that is immediately behind the coin in contact with said stopping member.

6. The coin carrying device according to claim 5, further comprising a retaining mechanism to retain said coin separating member in a position at which said contact part of said coin separating member is retracted from said carrying passage.

7. The coin carrying device according to claim 6, wherein a width of said carrying passage is adjustable to accommodate coins of different widths, and further comprising an interlocking mechanism to interlock said carrying structure with said coin separating member and also to automatically retain said coin separating member with said contact part thereof retracted from said carrying passage when the width of said carrying passage is adjusted.

8. The coin carrying device according to claim 5, wherein said contact part of said coin separating member comprises a roller.

9. The coin carrying device according to claim 8, wherein said coin separating member comprises a lever having one end thereof provided with said roller.

10. The coin carrying device according to claim 9, wherein said biasing member comprises a spring connected to another end of said lever.

11. The coin carrying device according to claim 5, wherein said coin separating member comprises a lever having one end thereof provided with said contact part.

12. The coin carrying device according to claim 6, wherein said biasing member comprises a spring connected to another end of said lever.

13. The coin carrying device according to claim 2, further comprising a retaining mechanism to retain said coin separating member in a position at which said contact part of said coin separating member is retracted from said carrying passage.

14. The coin carrying device according to claim 13, wherein a width of said carrying passage is adjustable to accommodate coins of different widths, and further comprising an interlocking mechanism to interlock said carrying structure with said coin separating member and also to automatically retain said coin separating member with said contact part thereof retracted from said carrying passage when the width of said carrying passage is adjusted.

15. The coin carrying device according to claim 2, wherein said contact part of said coin separating member comprises a roller.

16. The coin carrying device according to claim 15, wherein said coin separating member comprises a lever having one end thereof provided with said roller.

17. The coin carrying device according to claim 6, wherein said biasing member comprises a spring connected to another end of said lever.

18. The coin carrying device according to claim 2, wherein said coin separating member comprises a lever having one end thereof provided with said contact part.

19. The coin carrying device according to claim 18, wherein said biasing member comprises a spring connected to another end of said lever.

20. The coin carrying device according to claim 11, further comprising a retaining mechanism to retain said coin separating member in a position at which said contact part of said coin separating member is retracted from said carrying passage.

21. The coin carrying device according to claim 20, wherein a width of said carrying passage is adjustable to accommodate coins of different widths, and further comprising an interlocking mechanism to interlock said carrying structure with said coin separating member and also to automatically retain said coin separating member with said contact part thereof retracted from said carrying passage when the width of said carrying passage is adjusted.

22. The coin carrying device according to claim 1, wherein said contact part of said coin separating member comprises a roller.

23. The coin carrying device according to claim 22, wherein said coin separating member comprises a lever having one end thereof provided with said roller.

24. The coin carrying device according to claim 23, wherein said biasing member comprises a spring connected to another end of said lever.

25. The coin carrying device according to claim 1, wherein said coin separating member comprises a lever having one end thereof provided with said contact part.

26. The coin carrying device according to claim 18, wherein said biasing member comprises a spring connected to another end of said lever.

* * * * *